US006024303A

United States Patent [19]

Oremland

[11] Patent Number: 6,024,303

[45] Date of Patent: Feb. 15, 2000

[54] ERGONOMIC SHOWERHEAD PROTECTOR

[76] Inventor: George Alan Oremland, 179 Regatta Dr., Jupiter, Fla. 33477

[21] Appl. No.: 09/037,268

[22] Filed: Mar. 9, 1998

[51] Int. Cl.[7] ..... B05B 15/08

[52] U.S. Cl. ..... 239/587.4

[58] Field of Search ..... 239/587.1, 587.4, 239/587.5; 285/262, 266

[56] References Cited

U.S. PATENT DOCUMENTS

| | | | |
|---|---|---|---|
| 840,324 | 1/1907 | Hawley | 285/261 |
| 1,758,115 | 5/1930 | Kelly | 239/587.1 X |
| 2,273,395 | 2/1942 | Coufy | 285/270 |
| 2,647,796 | 8/1953 | Ziherl | 239/587.4 |
| 3,421,702 | 1/1969 | O'Brien | 239/587.4 X |
| 3,887,136 | 6/1975 | Anderson | 239/587.4 X |
| 4,103,830 | 8/1978 | Roth | 239/587.4 |

*Primary Examiner*—Kevin Weldon
*Attorney, Agent, or Firm*—McHale & Slavin, PA

[57] ABSTRACT

An ergonomic showerhead connector includes an adjustably-positioned conduit means that is selectively held in place by a locking apparatus. The conduit means includes an insertion plug with a contoured first end spaced apart from a threaded second end by a hollow stem portion. The insertion plug is pivotally disposed within the locking apparatus. The locking apparatus includes a coupler sleeve that secures the insertion plug first end against the exit of an existing water supply pipe. A control arm extends from the coupler sleeve and facilitates low-effort rotation of the locking apparatus between a loosened position and a securing position.

5 Claims, 16 Drawing Sheets

FIG. 2
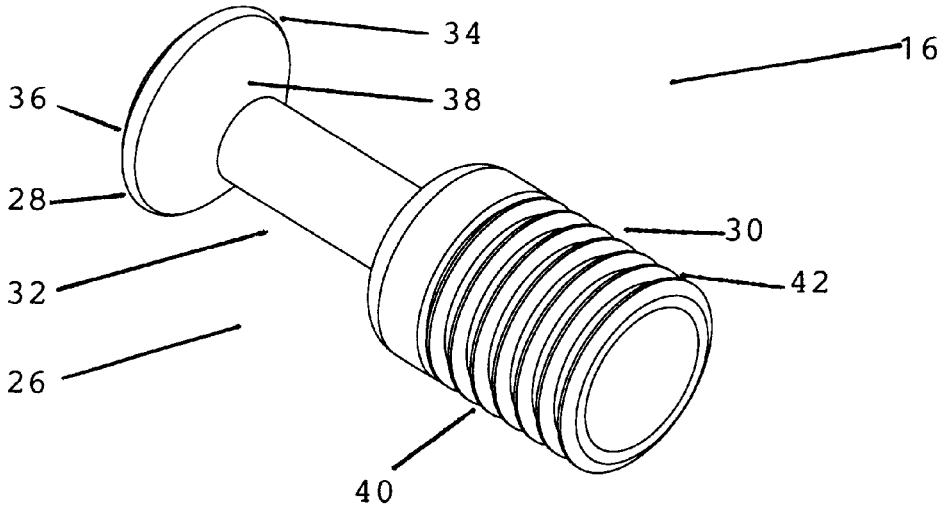
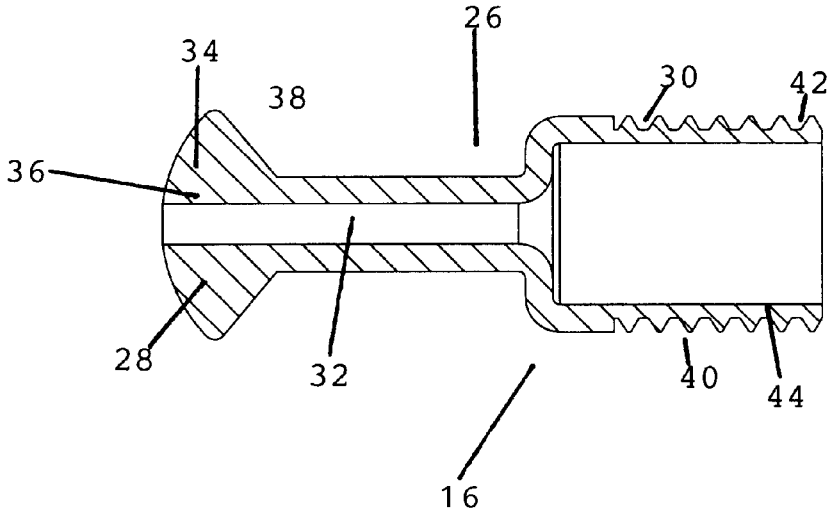
FIG. 3

FIG. 4
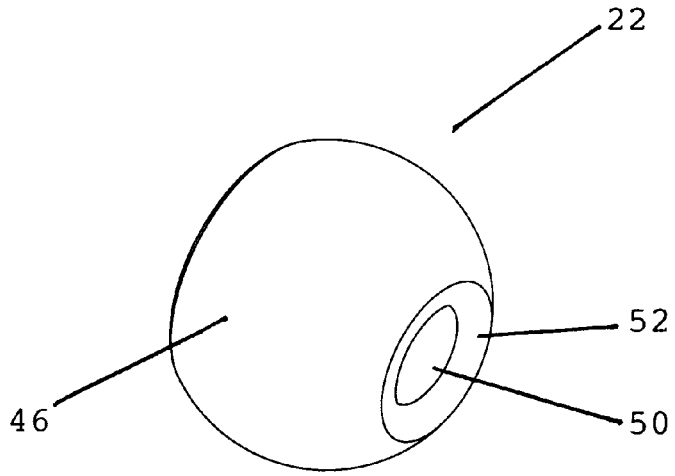
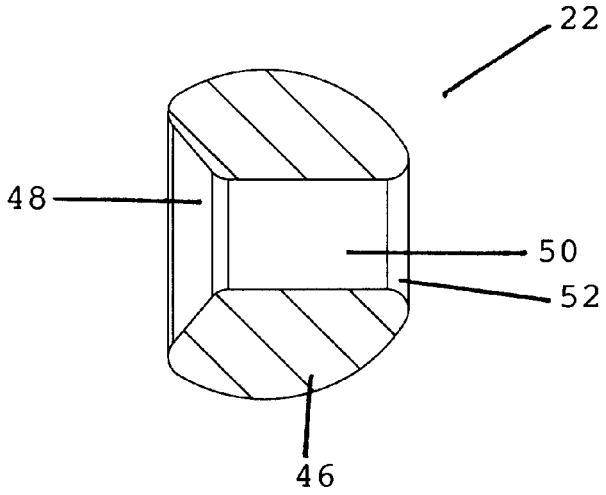
FIG. 5

FIG. 7
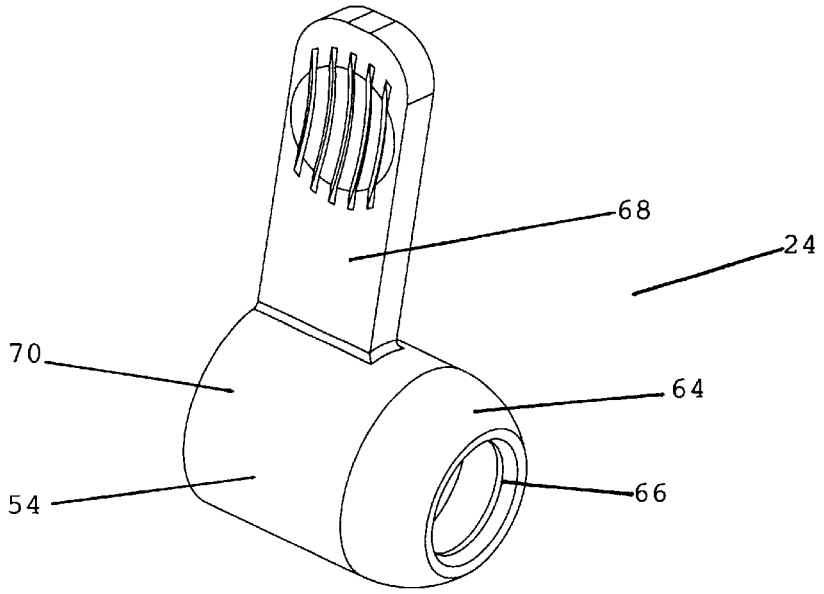
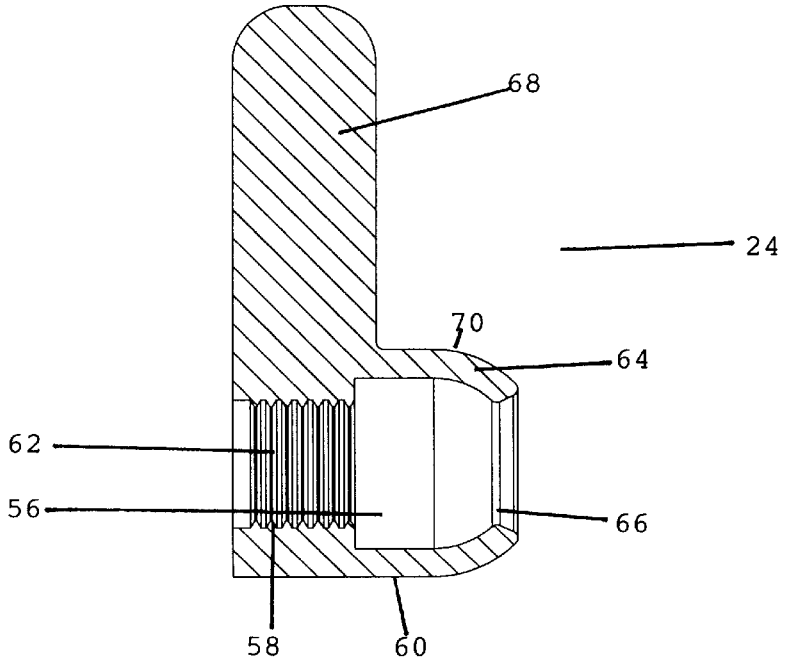
FIG. 8

FIG. 11
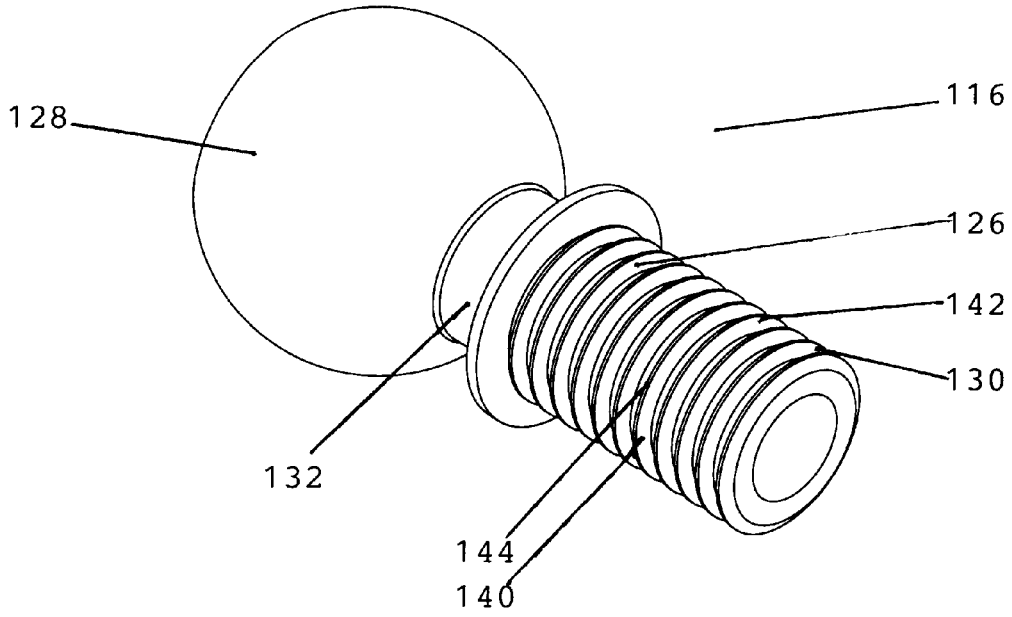
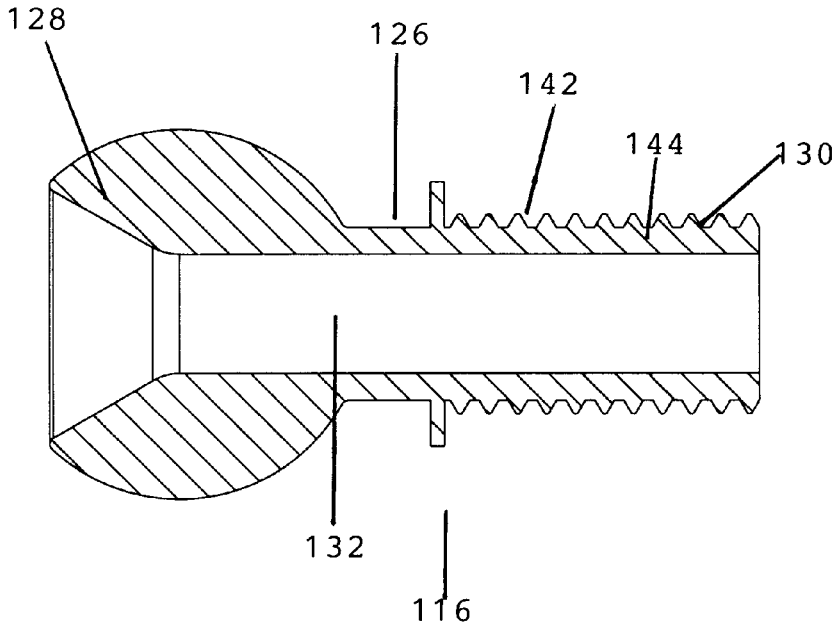
FIG. 12

FIG. 13
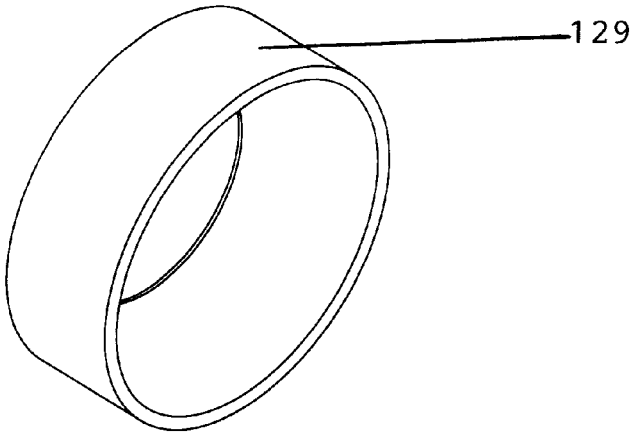
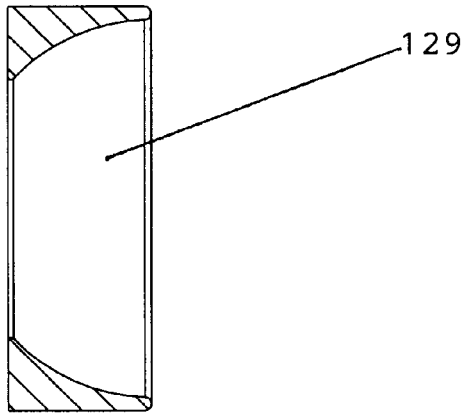
FIG. 14

FIG. 15
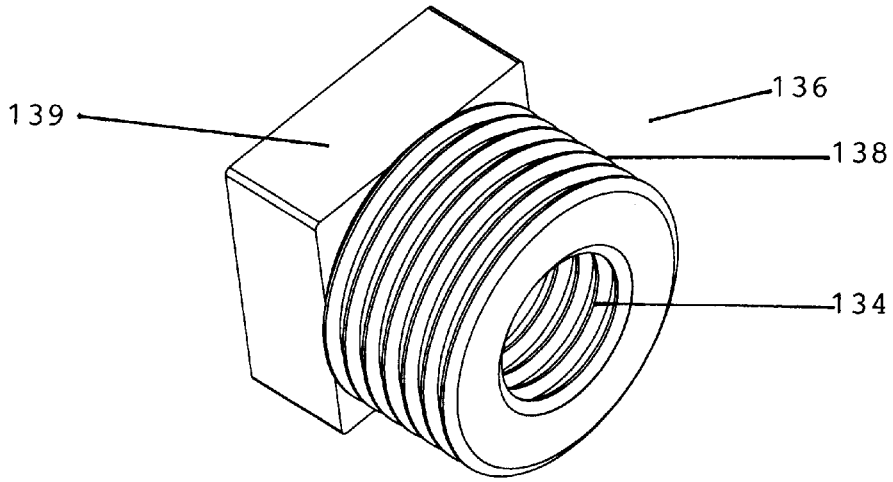
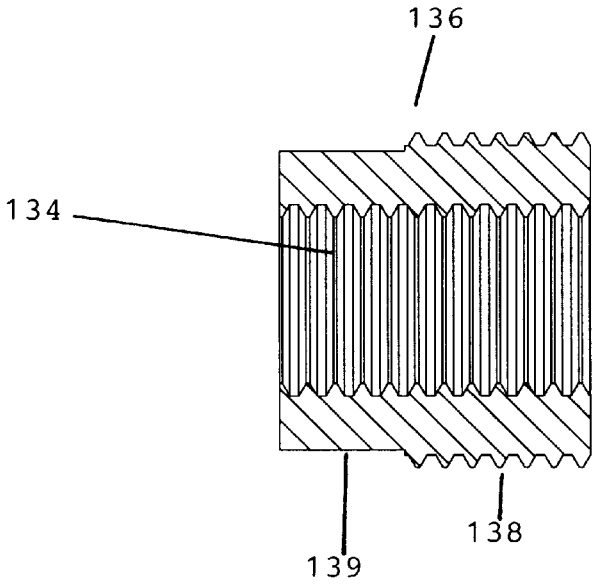
FIG. 16

FIG. 17
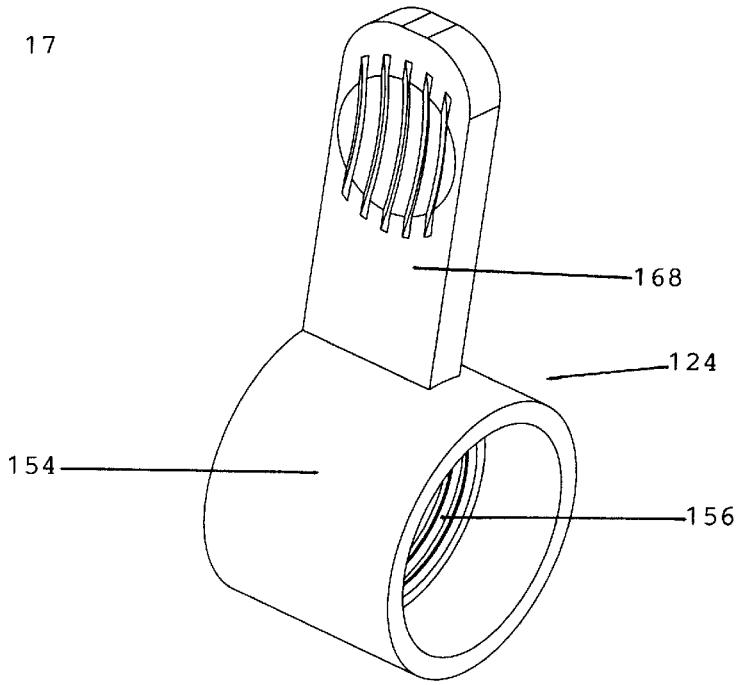
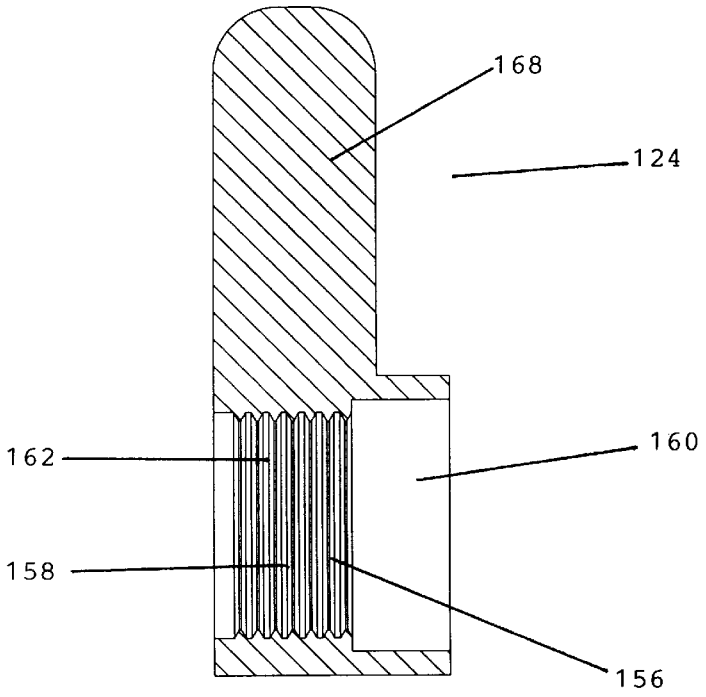
FIG. 18

FIG. 20
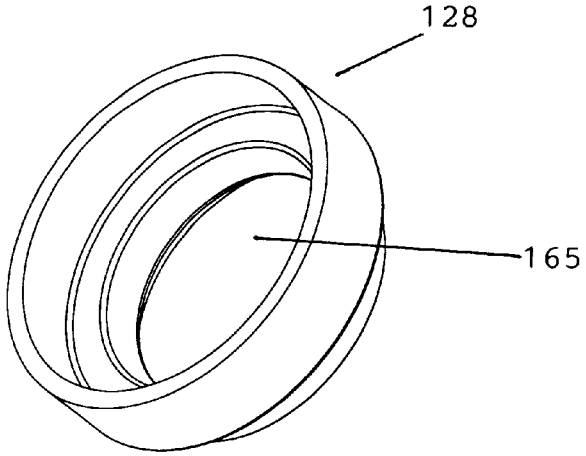
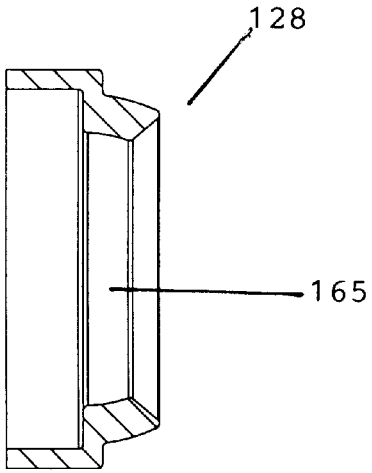
FIG. 21

FIG. 23
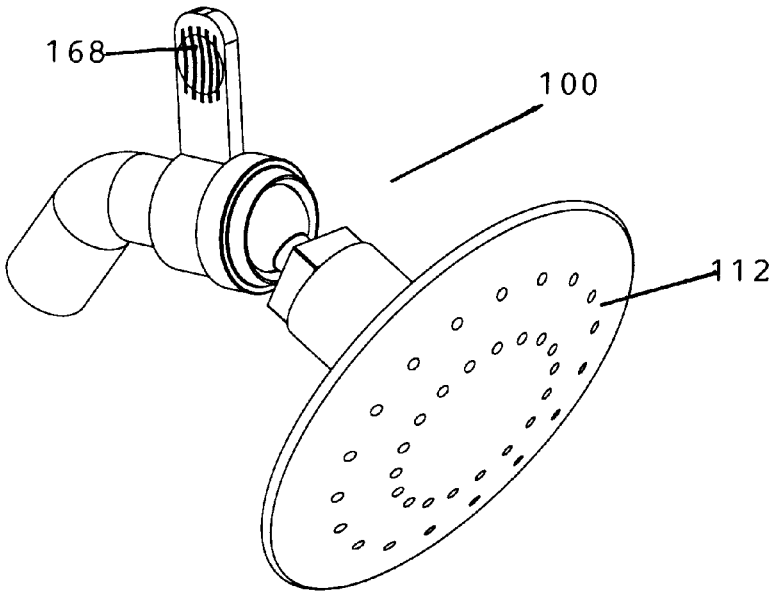
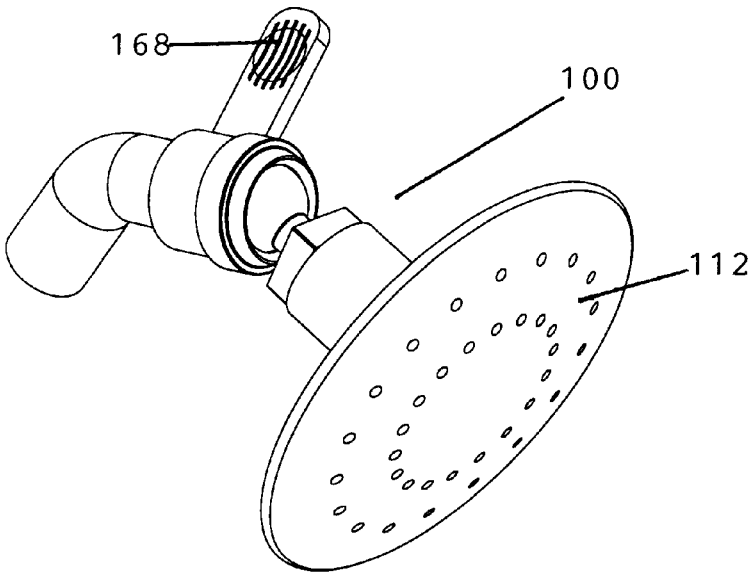
FIG. 24

FIG. 25
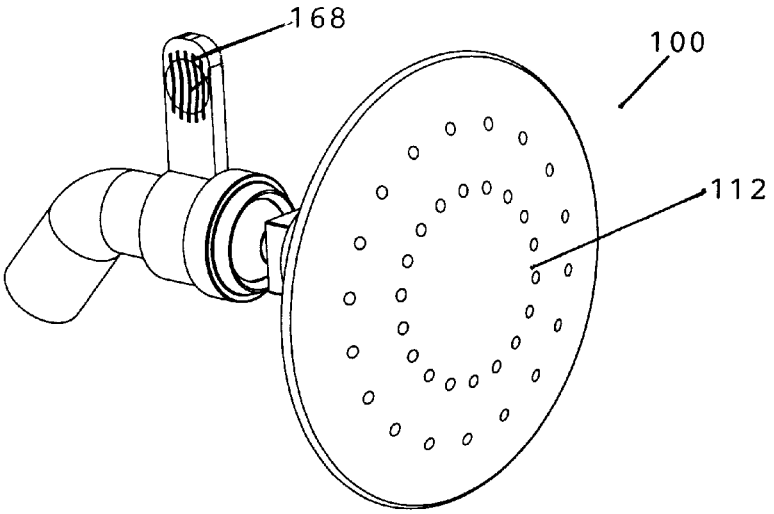
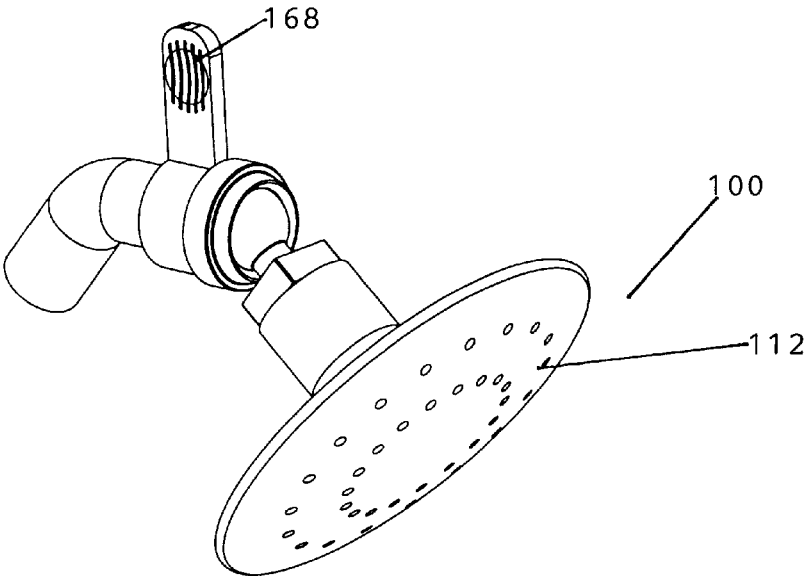
FIG. 26

ERGONOMIC SHOWERHEAD PROTECTOR

FIELD OF THE INVENTION

This invention is related to plumbing fixtures and, in particular, to a showerhead connector that allows adjustment without tools.

BACKGROUND OF THE INVENTION

Numerous plumbing fixtures are available for purposes of customizing a shower. A popular fixture consists of a showerhead capable of controlling water spray and flow rate during a shower. For example, so-called "low-flow" showerheads devices limit water flow rates, thereby reducing the amount of water used and associated water bill. Other showerhead devices generate pulsating jets of water for massage of muscles.

Of course, to clean effectively, water spray must be directed properly, whether it is low-flow, massaging, or otherwise. In recognition of this need, some shower-enhancing devices provide water spray aiming features. For example, some a showerhead fixture may have a detachable hand-held portion for individual preference aiming. Other showerhead fixtures may include a ball-and-socket attachment to allow pivoting of a terminal portion of the showerhead.

While these designs may be suitable for certain situations, they have limited applicability. For example, the removable hand-held models are difficult to use during two-handed operations, like hair washing. The ball-and-socket attachments also help in some instances, but they are not entirely suitable for use with heavy or pulsating showerheads.

The difficulty presented by known showerhead designs stems from a tradeoff between adjustability and stability. That is, showerheads that are easily adjusted often do not remain in a user-selected orientation for very long. Alternately, showerheads that maintain a given direction are often difficult to adjust.

The very characteristics that promote ease of adjustment also allow unwanted, uncontrolled motion. This uncontrolled motion typically comes simply as the result of gravity or repetitive motion inherent in pulsating showerheads. Known showerheads that are easy to adjust are often plagued by stability troubles. In addition, the more a showerhead is adjusted, the less stable is becomes as the ball/socket begins to wear out.

Conversely, showerheads that are less prone to unwanted motion incorporate fittings that rely upon high degrees of friction. As a result, they require a firm grip when adjustments are to be made. This requirement is often troublesome. Sufferers of arthritis or children may not have the hand strength required to adjust this type of showerhead. Additionally, the only way to produce the required grip is through the use of tools. It the wrong tool is used, the fixture surface may become stripped, preventing future adjustments, even with the correct tool. Even if the proper tool is available, the mere necessity of a tool requirement for adjusting the showerhead inhibits it adjustability. As a result, shower takers with this type of fixture typically predict one optimal showerhead position. Should family members of different heights use the shower, what is convenient to one family member may be inconvenient to another. Known direction-maintaining showerheads often solve one problem only to cause others.

Thus, what is needed is a showerhead connector that includes advantages of the known devices, while addressing the shortcomings they exhibit. The connector should be easily adjustable without tools, yet able to maintain a user-selected position as desired. The connector should be adjustable during a shower and should not require large amounts of hand strength to operate. The connector should also accommodate existing plumbing fixtures, without the need for special installation techniques or showerhead modifications.

SUMMARY OF THE INVENTION

The instant invention is an ergonomic showerhead connector designed to be adjusted without tools and to maintain a user-selected orientation as required. The device includes several cooperative elements that work with existing shower fixtures.

In a first embodiment, the connector employs a conduit means that includes an insertion plug having a first end separated from a second end by an essentially-hollow stem portion that extends therebetween. The first end is contoured and abuts the exit of an existing water supply pipe. The second end is threaded and engages an existing showerhead. The stem allows fluid to flow from the water supply pipe into the showerhead.

The connector also employs a positioning means that works with a locking means, described below, to allow placement of the connector in a user-selected orientation. The positioning means includes an essentially-hollow orientation member that is shaped to encircle the stem portion of the conduit means insertion plug. The orientation member is substantially spherical but has sides that accommodate the insertion plug first and second ends, allowing the insertion plug to extend beyond the orientation member.

The above-mentioned locking means includes a coupler sleeve that secures the conduit means against the existing water supply pipe. The coupler sleeve has a vacant interior divided into two sections: an attachment region and a securing cavity. The attachment region is threaded and screws onto the threaded end of an existing water supply pipe. The securing cavity houses the orientation member and a substantial portion of the insertion plug. In a loosened orientation, the locking means allows the positioning means to pivot, thereby facilitating motion of the insertion plug and associated showerhead. In a securing orientation, the locking means keeps the orientation member from moving, thereby maintaining the conduit means and showerhead in a selected position. The locking means also includes a control arm that extends radially outward from the coupler sleeve exterior. This control arm provides a high-leverage gripping surface and facilitates rotation of the coupler sleeve between the loosened and securing orientations, as desired.

In a second embodiment, the conduit means includes an insertion plug having a contoured first end separated from a second end by an essentially-hollow stem portion. The first end cooperates with a sealing washer disposed against the water supply pipe exit to ensure a watertight connection between the water supply pipe and the insertion plug first end.

The second end is threaded and shaped to engage an attachment adaptor. The attachment adaptor links the insertion plug to the showerhead entrance. The attachment adaptor is threaded, but includes gripping edges. Once the attachment adaptor has been secured onto the insertion plug second end, the gripping edges facilitate relative twisting between the showerhead and insertion plug, while preventing unwanted rotation of the insertion plug with respect to the water supply pipe.

The insertion plug cooperates with a locking means to allow placement of the connector in a user-selected orientation. The locking means includes a coupler sleeve that secures the conduit means against the existing water supply pipe. The coupler sleeve has a vacant interior divided into two sections: an attachment region and a securing cavity. The attachment region is threaded and screws onto the threaded end of an existing water supply pipe. The securing cavity houses the above-mentioned sealing washer and a substantial portion of the insertion plug first end. In a loosened orientation, the locking means allows the insertion plug to pivot, thereby facilitating motion of the insertion plug and associated showerhead. In a securing orientation, the locking means keeps the insertion plug from moving, thereby maintaining the conduit means and showerhead in a selected position. The locking means also includes a control arm that extends radially outward from the coupler sleeve exterior. This control arm provides a high-leverage gripping surface and facilitates rotation of the coupler sleeve between the loosened and tightened orientations, as desired.

Thus, it is an object of the instant invention to provide an ergonomic showerhead connector that is adjustable without tools, yet does not require large amounts of hand strength during adjustment.

It is a further object of the instant invention to provide an ergonomic showerhead connector that is able to maintain a user-selected position until a new position is selected.

It is yet another object of the instant invention to provide an ergonomic showerhead connector that accommodates existing plumbing fixtures, without the need for special installation techniques or showerhead modifications.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWING

FIG. 2 is a pictorial view of the insertion plug of the showerhead connector shown in FIG. 1;

FIG. 3 is a cross-section view of the insertion plug of the showerhead connector shown in FIG. 2;

FIG. 4 is a pictorial view of the orientation member of the showerhead connector shown in FIG. 1;

FIG. 5 is a cross-section view of the orientation member of the showerhead connector shown in FIG. 4;

FIG. 7 is a pictorial view of the coupler sleeve and control arm of the showerhead connector shown in FIG. 1;

FIG. 8 is a cross-sectional view of the coupler sleeve and control arm of the showerhead connector shown in FIG. 7;

FIG. 11 is a perspective view of the insertion plug of FIG. 10;

FIG. 12 is a cross section view of the insertion plug of FIG. 10;

FIG. 13 is a perspective view of the sealing washer shown in FIG. 10;

FIG. 14 is a cross section view of the sealing washer shown in FIG. 10;

FIG. 15 is a perspective view of the attachment adaptor shown in FIG. 10;

FIG. 16 is a cross section view of the attachment adaptor shown in FIG. 10;

FIG. 17 is a perspective view of the coupler sleeve shown in FIG. 10;

FIG. 18 is a cross section view of the coupler sleeve shown in FIG. 10;

FIG. 20 is a perspective view of the retaining collar shown in FIG. 10;

FIG. 21 is a cross section view of the retaining collar shown in FIG. 10;

FIG. 23 is a pictorial view of the connector shown in FIG. 10, with the control arm in a securing position;

FIG. 24 is a pictorial view of the connector shown in FIG. 10, with the control arm in a loosened position;

FIG. 25 is a pictorial view of the connector shown in FIG. 10, with the control arm in a loosened position; and FIG. 26 is a pictorial view of the connector shown in FIG. 10, with the control arm in a securing position.

DETAILED DESCRIPTION OF THE PREFERRED EMBODIMENT

Figure 1:
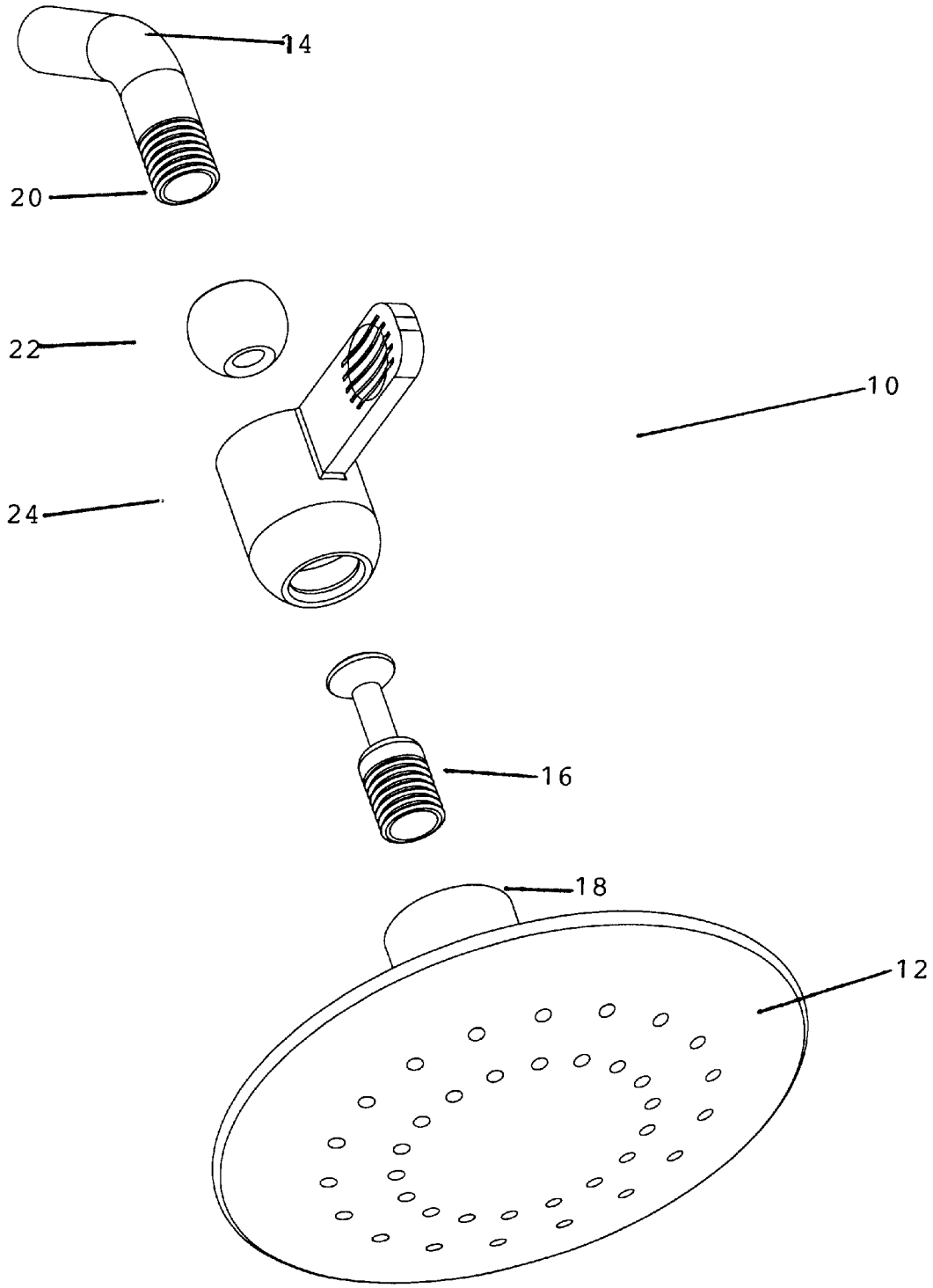
FIG. 1 is an exploded view of a first embodiment of the ergonomic showerhead connector of the present invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 9:
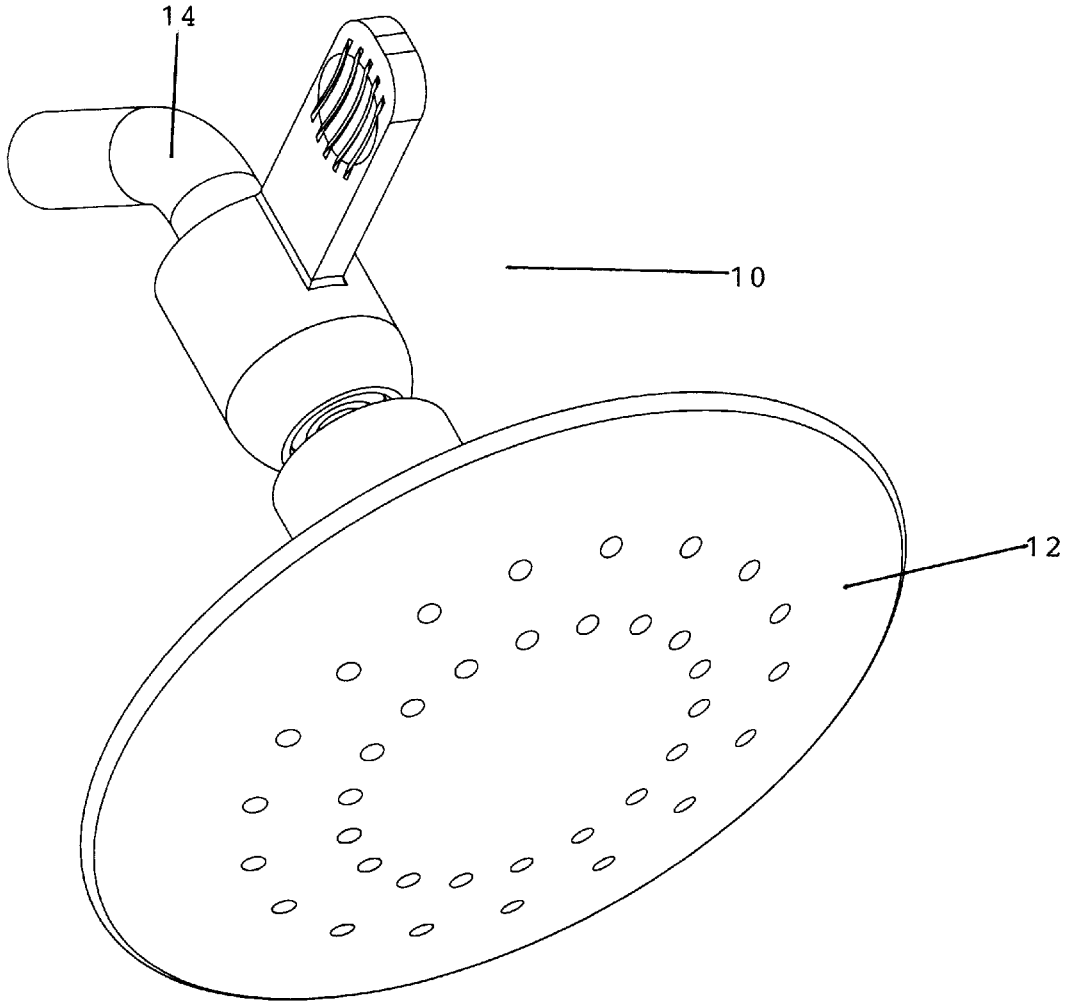
FIG. 9 is a pictorial view of the showerhead connector of FIG. 1 installed and ready for use.

Now with respect to FIG. 1, an exploded view of the ergonomic showerhead connecter 10 according to the present invention is shown. By way of overview, the connector 10 joins a showerhead 12 to a water supply pipe 14 in a secure, yet easily-adjustable, user-selected position. The connector 10 employs a conduit means 16 that fluidly links the showerhead entrance 18 to the water supply pipe exit 20. A positioning means 22 allows the conduit means 16 and showerhead 12 to move as a unit in a controlled manner with respect to the water supply pipe 14. A locking means 24 secures the conduit means 16 into place, alternately allowing and preventing movement of the conduit means and attached showerhead 12. A locking means 24 secures the conduit means 16 into place, alternately allowing and preventing movement of the conduit means and attached shower head 12. The connector is shown in use in FIG. 9.

With additional reference to FIGS. 2 and 3, the conduit means 16 includes an elongated insertion plug 26 having a contoured first end 28 spaced apart from a threaded second end 30 by an essentially-hollow stem 32 extending therebetween. The insertion plug first end 28 includes a tapered flange 34 characterized by a curved distal side 36 and an opposite, frusto-conical proximal side 38. The insertion plug second end 30 includes a sleeve 40 having a first set of threads 42 on an exterior surface 44 thereof. These sleeve threads 42 are sized and positioned to engage threads, not shown, disposed within the showerhead entrance 18, so that the showerhead 12 may be screwed in place, directly onto the insertion plug second end 30. The hollow stem 32 allows fluid to pass through the insertion plug 26, from the first end 28 to the second end 30.

Figure 6:
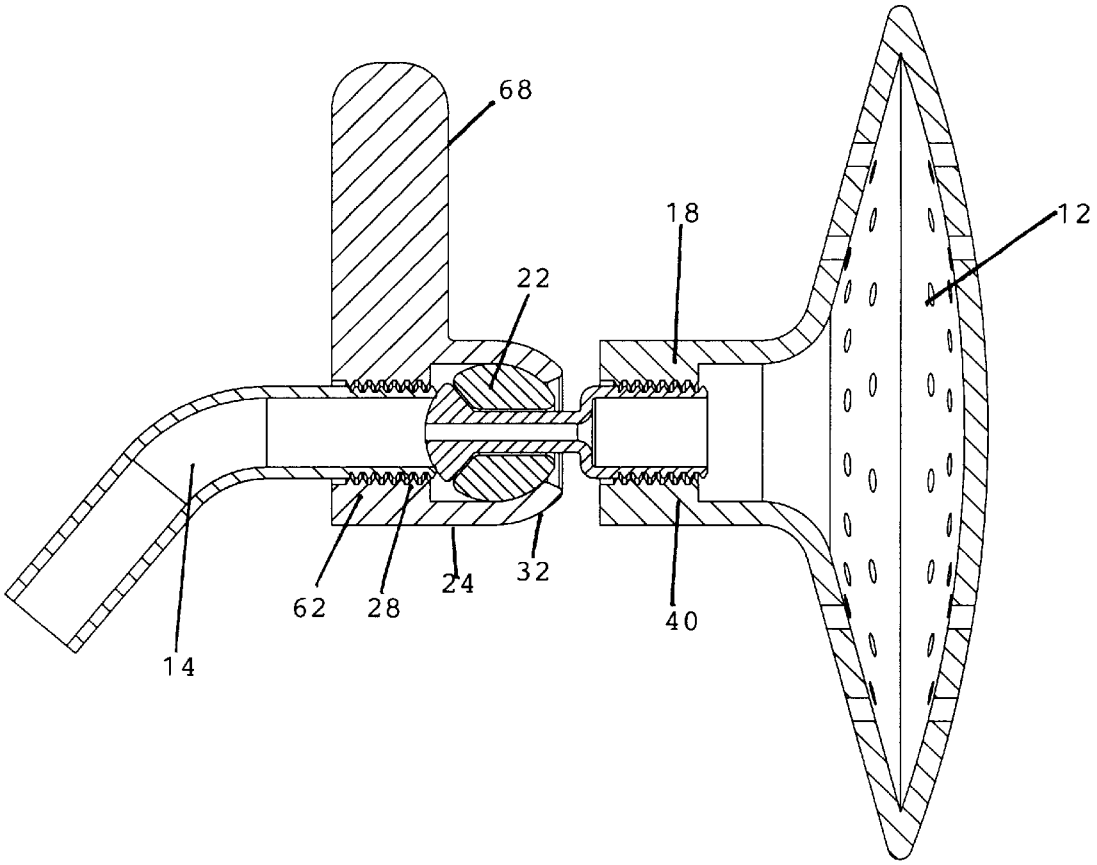
FIG. 6 is a cross-section of the showerhead connector of FIG. 1 in place, joining an existing showerhead with the exit of an existing water supply pipe.

Now with respect to FIGS. 4 and 5, the positioning means 22 includes a substantially-spherical orientation member 46. The orientation member 46 is resiliently-deformable and shaped to accommodate the insertion plug 26. The orientation member 46 includes a distal divot 48 shaped to engage the proximal side 38 of the insertion plug first end 28. A cylindrical interior bore 50 joins the distal divot with an opposite proximal divot 52 and accepts the insertion plug stem 32. With this arrangement, as shown in FIG. 6, the insertion plug 26 will remain securely disposed within the orientation member 46, with the plug second end 30 extending therefrom.

With respect to FIGS. 7 and 8, the locking means includes an elongated coupler sleeve 54 shaped to selectively maintain the orientation member 46 and insertion plug first end 28 against the water supply pipe exit 20. More specifically, the coupler sleeve 54 resembles a hollow cylinder, having a vacant interior 56 divided into an attachment region 58 and a securing cavity 60. The attachment region 58 includes a second set of threads 62 sized, as shown in FIG. 6, to engage a threaded exit end 20 of the water supply pipe 14. The securing cavity 60 is adjacent the attachment region 58, and the securing cavity and attachment region are coaxial. The securing cavity 60 is sized to contain the insertion plug first end 28, the orientation means 46, and a majority of the insertion plug stem 32. The securing cavity is further characterized by a tapered neck portion 64 that terminates in a flared end aperture 66.

The orientation member 46 and insertion plug 26 move as a unit within the securing cavity 60, and a portion of the insertion plug stem 32 extends through the coupler sleeve end aperture 66. Although the securing cavity 60 is large enough to permit free rotation of the orientation member 46 and insertion plug 26, the neck portion 64 is sized to prevent passage of the orientation member through the end aperture 66. As a result, while the coupler sleeve 54 is screwed onto the water supply pipe 14, the pipe exit 20 and coupler sleeve tapered neck portion 64 cooperatively prevent the orientation member 46 and insertion plug 26 from escaping the securing cavity 60. Additionally, the tapered neck region 64 and water supply pipe exit 20 act in concert with the orientation member 46 to selectively secure the insertion plug 26 in a user-selected orientation, as described below.

The locking means includes a control arm 68 that extends orthogonally outward from the coupler sleeve outer surface 70. In keeping with the objects of the present invention, this control arm 68 facilitates gripping the coupler sleeve 54, even by soapy hands and when the sleeve is wet. The control arm 68 provides a positive gripping surface that does not rely upon friction to produce coupler sleeve 54 rotation. As a result, the positioning means 22 of the present invention provides a wide degree of showerhead adjustability, while eliminating the need for adjusting and securing tools. As an added benefit of this feature, the present invention may be adjusted, and secured, as easily during a shower as when the water is turned off.

As described immediately below, the positioning means 22, the conduit means 16, and the locking means 24 enjoy a synergistic relationship. When the coupler sleeve 54 is rotated, the threaded attachment region 58 engages the water supply pipe exit 20, and the coupler sleeve moves longitudinally with respect to the pipe exit. This longitudinal motion, depending upon direction, alternatively compresses or releases the orientation member 46 within the securing cavity 60. As the coupler sleeve 54 is tightened, the orientation member 46 is squeezed between the coupler sleeve tapered neck portion 64 and the distal side 36 of the insertion plug first end 28. As the orientation member 46 compresses, it flattens out, becoming thinner and expanding against the interior of the securing cavity 60. With continued tightening, the orientation member 46 is forced, under increasing pressure, against the proximal side 38 of the insertion plug first end 28. In turn, the distal side 36 of the insertion plug first end 28 is forced against the water supply pipe exit 20, forming a watertight seal. Loosening the coupler sleeve 54 will release the orientation member 46, allowing showerhead 12 adjustment.

The present invention advantageously maintains a watertight relationship with the water supply pipe 14, even when the coupler sleeve 54 is not tightened. As seen in FIG. 6, the distal side 36 of the insertion plug first end 28 remains in contact with the water supply pipe exit 20 throughout the available range of insertion plug 26 positions. Furthermore, the orientation member 46 substantially fills the securing cavity 60 even if not compressed. This arrangement allows the present invention to be adjusted and moved, leak-free, while the shower is in use. This feature allows a shower taker to direct the shower spray in one position for hair washing and in other locations, as needed, for the balance of the shower. In this manner, infinite adjustments may be made during a single shower, with no need to stop the shower if adjustments are desired.

Figure 10:
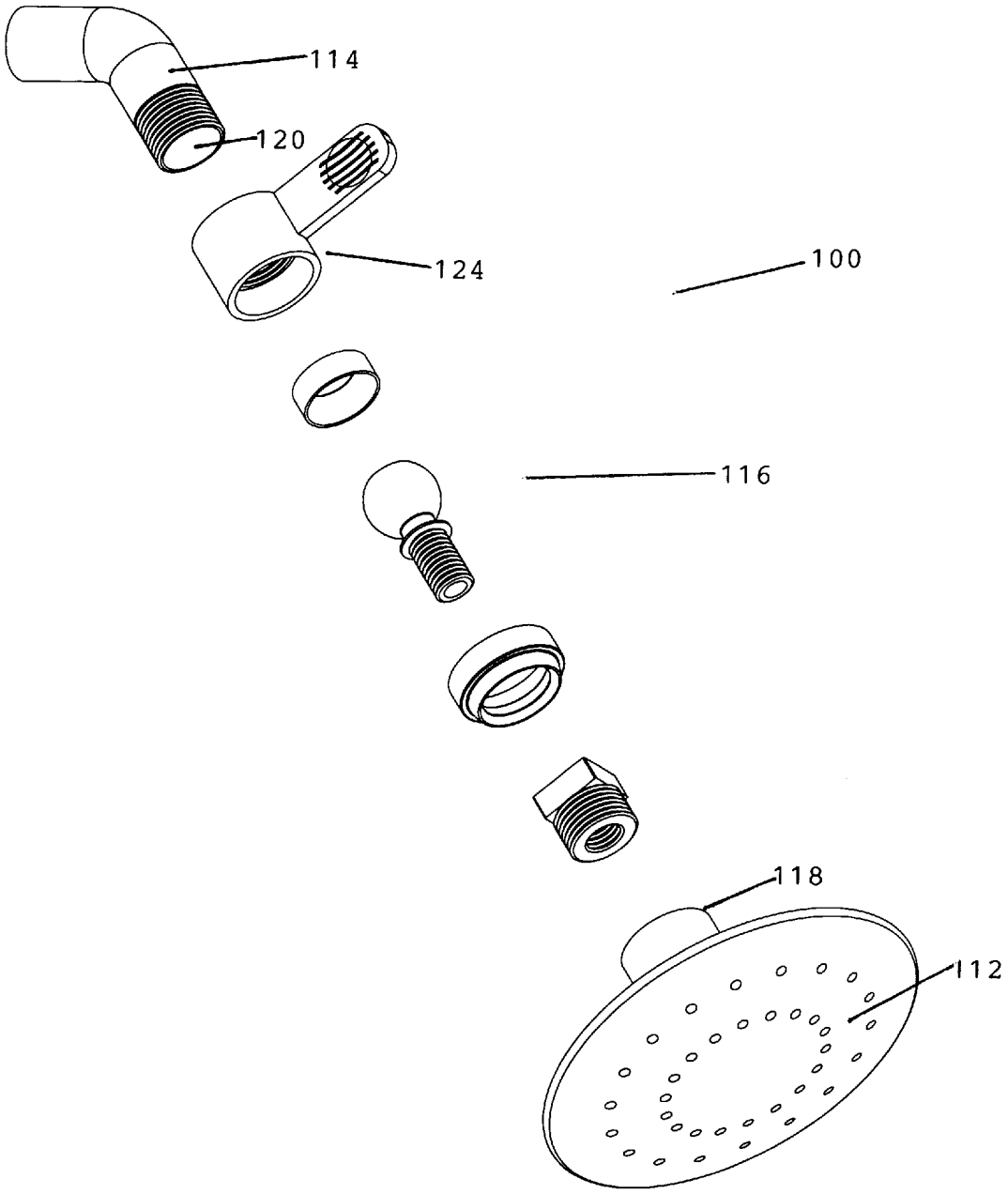
FIG. 10 is an exploded view of a second embodiment of the showerhead connector of present invention.
Figure 22:
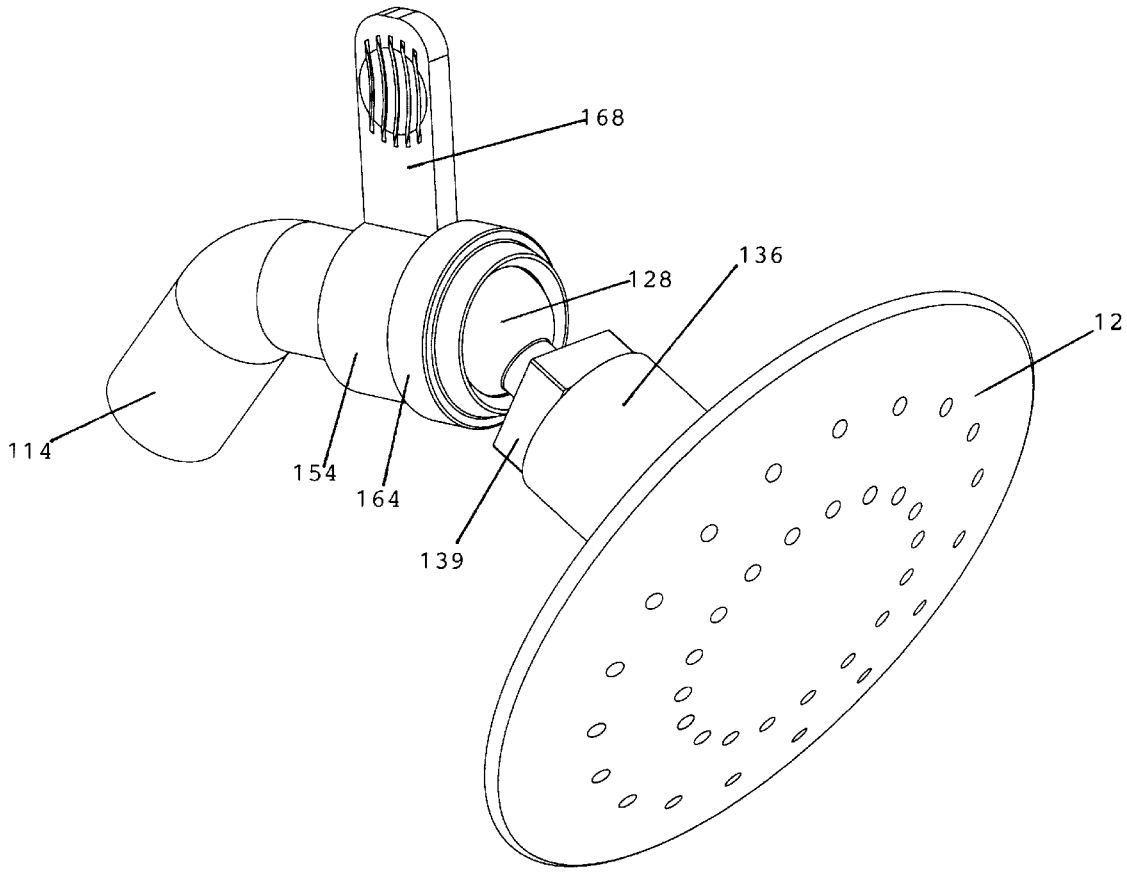
FIG. 22 is a pictorial view of the connector shown in FIG. 10.

With reference to FIGS. 10–26, a second embodiment of the connector 100 of the present invention is now described. As shown in FIG. 10, the connector 100 joins a showerhead 112 to a water supply pipe 114 in a secure, yet easily-adjustable, user-selected position. The connector 100 employs an adjustably-oriented conduit means 116 that fluidly links the showerhead entrance 118 to the water supply pipe exit 120. A locking means 124 secures the conduit means 116 into place, alternately allowing and preventing movement of the conduit means and attached shower head 112. The connector is shown in use in FIG. 22.

With particular reference to FIGS. 11 and 12, the conduit means 116 includes an elongated insertion plug 126 having a contoured first end 128 spaced apart from a threaded second end 130 by an essentially-hollow stem 132. The insertion plug first end 128 is substantially-spherical and shaped to engage a sealing washer 129, as described below. The sealing washer 129 is shown in FIGS. 13 and 14.

The insertion plug second end 130 includes a sleeve 140 having a first set of threads 142 on an exterior surface 144 thereof. These sleeve threads 142 are sized and positioned to engage a threaded interior 134 of an attachment adaptor 136, shown in FIGS. 15 and 16. In turn, the threaded exterior 138 of the attachment adaptor 136 is screwed into the showerhead entrance 118. The attachment adaptor 136 includes gripping edges 139 that facilitate twisting of the showerhead 112 with respect to the insertion plug 126, without producing relative motion between the insertion plug 126 and the water supply pipe 114.

With respect to FIGS. 17 and 18, the locking means 124 includes an elongated coupler sleeve 154 shaped to selectively maintain the orientation member 146 and insertion plug first end 128 against the water supply pipe exit 120. More specifically, the coupler sleeve 154 resembles a hollow cylinder, having a vacant interior 156 divided into an attachment region 158 and a securing cavity 160. The attachment region 158 includes a second set of threads 162 sized, as shown in FIG. 15, to engage a threaded exit end 120 of the water supply pipe 114. The securing cavity 160 is adjacent to the attachment region 158; the securing cavity and attachment region are coaxial.

Figure 19:
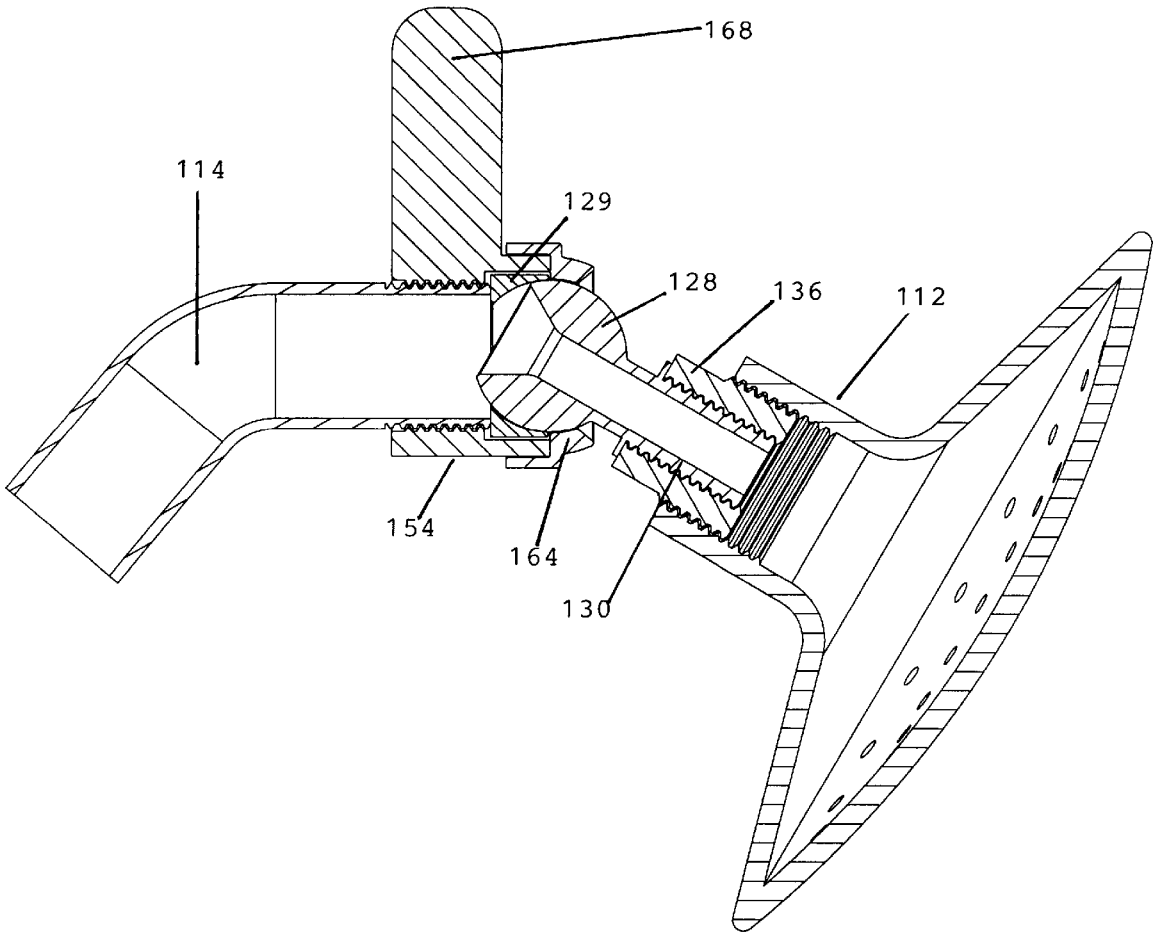
FIG. 19 is a cross section view of the connector shown in FIG. 10.

As shown in FIG. 19, the securing cavity 160 is sized to contain the sealing washer 129 and a portion of the insertion plug first end 128. With additional reference to FIGS. 20 and 21, a retaining collar 164 is attached to a terminal end of the coupler sleeve 154. The retaining collar 164 includes a passthrough aperture 165 that engages the insertion plug first end 128. The retaining collar 164 and the coupler sleeve securing cavity 160 cooperate to allow rotation of the insertion plug first end 128, while the retaining collar 164 keeps the insertion plug first end against the water supply pipe exit 120 and sealing washer 129. As a result, when the coupler sleeve 154 is screwed onto the water supply pipe 114, the pipe exit 120 and retaining collar 164 cooperatively prevent the insertion plug 126 from escaping the securing cavity 160. Additionally, the retaining collar 164 and water supply pipe exit 120 act in concert with the insertion plug first end 128 to selectively secure the insertion plug 126 in a user-selected orientation, as described below.

The locking means further includes a control arm 168 that extends orthogonally outward from the coupler sleeve outer surface 170. In keeping with the objects of the present invention, this control arm 168 facilitates gripping the coupler sleeve 154, even by soapy hands and when the sleeve is wet. The control arm 168 provides a positive gripping surface that does not rely upon friction to produce coupler sleeve 154 rotation. As a result, the locking means 124 of the present invention 100 allows a wide degree of showerhead adjustability, while eliminating the need for adjusting and securing tools. As an added benefit of this feature, the present invention 100 may be adjusted, and secured, as easily during a shower as when the water is turned off.

As described immediately below, the conduit means 116 and the locking means 124 enjoy a synergistic relationship. When the coupler sleeve 154 is rotated, the threaded attachment region 158 engages the water supply pipe exit 120, and the coupler sleeve moves longitudinally with respect to the pipe exit. This longitudinal motion, depending upon direction, alternatively locks or releases the insertion plug first end 128 within the securing cavity 160. As the coupler sleeve 154 is tightened, the insertion plug first end 128 is forced, by the retaining collar 164, against the sealing washer 129. With continued tightening, the sealing washer 129 is forced with increasing pressure against the water supply pipe exit 120. This tightening locks the showerhead 112 in place, as shown in FIG. 23. With reference to FIGS. 24 and 25, loosening the coupler sleeve 154 will release the orientation member 146, allowing the showerhead 112 to be placed in a new position. As shown in FIG. 26, retightening the coupler sleeve will lock the showerhead 112 in a newly-selected position.

The present invention advantageously maintains a watertight relationship with the water supply pipe 114, even when the coupler sleeve 154 is not tightened. As seen in FIG. 15, the sealing washer 129 and the insertion plug first end 128 remain in contact with the water supply pipe exit 120 throughout the available range of insertion plug 126 positions. This arrangement allows the present invention to be adjusted and moved, leak-free, while the shower is in use. This feature allows a shower taker to direct the shower spray in one position for hair washing and in other locations, as needed, for the balance of the shower. In this manner, infinite adjustments may be made during a single shower, with no need to stop the shower if adjustments are desired.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A showerhead connector adapted to adjustably join a showerhead to a water supply pipe, said connector comprising:

a conduit means for fluidly joining an exit of a water supply pipe with an entrance of a showerhead; said conduit means including an insertion plug having a first end spaced apart from a second end by an essentially-hollow stem extending therebetween; said first end having a contoured first surface adjacent said water supply pipe and an opposite second surface; said first surface being adapted to engage a distal end of a water supply pipe thereby forming a first water seal; and said second end adapted to engage an entrance of a showerhead;

a positioning means for adjustably placing said conduit means in a user-selected orientation, said positioning means including a substantially-spherical orientation member having an outer diameter that is larger than an inner diameter of said tapered neck portion, said outer diameter approximating an inner diameter of a securing cavity, said positioning means being resiliently-compressible to engage an interior surface of said securing cavity thereby selectively forming a second water seal, said orientation member including an interior bore sized to accommodate said stem, said bore defining an orientation member first end and an orientation member second end; said orientation member first end being adapted to engage said essentially-hollow stem; and said orientation means second end being adapted to engage said tapered neck portion of said coupling sleeve; and a locking means for selectively maintaining said conduit means in said user-selected orientation, said locking means including a coupler sleeve, said coupler sleeve including a vacant interior, said vacant interior including an attachment region and said securing cavity, said attachment region including a set of threads sized and positioned to engage an exit of said outlet pipe, and said securing cavity including a tapered neck portion, whereby said orientation member cooperates with said coupler sleeve to maintain said insertion plug in a user-selected orientation and whereby said second water seal is formed by longitudinal movement of said coupling sleeve toward said water pipe sufficient to compress said orientation member between said tapered neck portion and said insertion plug first end second side.

2. The showerhead connector of claim 1, wherein said locking means further includes:

a control arm extending radially from said coupler sleeve, whereby said control arm facilitates rotation of said coupler sleeve between a securing orientation and a loosened orientation.

3. A showerhead connector adapted to adjustably join a showerhead to a water supply pipe, said connector comprising:

a conduit means for fluidly joining an exit of a water supply pipe with an entrance of a showerhead, said conduit means including an insertion plug having a first end spaced apart from a second end by an essentially-hollow stem extending therebetween; said first end having a contoured first surface adjacent said water supply pipe and an opposite second surface; said first surface being adapted to engage a distal end of a water supply pipe thereby forming a first water seal; and said second end adapted to engage an entrance of a showerhead;

a locking means for selectively maintaining said conduit means in said user-selected orientation; said locking means including a coupler sleeve, said coupler sleeve including a vacant interior, said vacant interior including an attachment region and a securing cavity, said attachment region including a set of threads sized and positioned to engage an exit of said outlet pipe; and a retaining collar removably secured to said securing cavity, said retaining collar including a passthrough aperture sized to accommodate said insertion plug; and a positioning means for adiustably placing said conduit means in a user-selected orientation, said positioning means including a substantially-spherical orientation member having an outer diameter that is larger than an inner diameter of said passthrough aperture, said outer diameter approximating an inner diameter of said securing cavity, said positioning means being resiliently-compressible to engage an interior surface of said securing cavity thereby selectively forming a second water seal, said orientation member including an interior bore sized to accommodate said stem;

whereby said orientation member cooperates with said coupler sleeve to maintain said insertion plug in a user-selected orientation.

4. The showerhead connector of claim 3, wherein said locking means further includes:

a control arm extending radially from said coupler sleeve, whereby said control arm facilitates rotation of said coupler sleeve between a securing orientation and a loosened orientation.

5. The showerhead connector of claim 4, further including an attachment adaptor disposed between said insertion plug second end and said showerhead.

* * * * *